US005715944A

United States Patent [19]

Windisch

[11] Patent Number: 5,715,944

[45] Date of Patent: Feb. 10, 1998

[54] TRANSPORT VASE FOR CUT FLOWERS

[75] Inventor: Walter Wolf Windisch, Bottighofen, Switzerland

[73] Assignee: Heinz-Dieter Schmidt, Germany

[21] Appl. No.: 290,747

[22] PCT Filed: Feb. 10, 1993

[86] PCT No.: PCT/EP93/00325

§ 371 Date: May 22, 1995

§ 102(e) Date: May 22, 1995

[87] PCT Pub. No.: WO93/15979

PCT Pub. Date: Aug. 19, 1993

[30] Foreign Application Priority Data

Feb. 14, 1992 [CH] Switzerland ..... 452/92
Sep. 18, 1992 [CH] Switzerland ..... 2943/92

[51] Int. Cl.[6] ..... B65D 85/52

[52] U.S. Cl. ..... 206/423; 47/84

[58] Field of Search ..... 47/73, 74, 80, 47/81, 84; 206/423

[56] References Cited

U.S. PATENT DOCUMENTS

| | | | |
|---|---|---|---|
| 2,340,373 | 2/1944 | Gardner | 206/423 X |
| 2,774,187 | 12/1956 | Smithers | 47/84 X |
| 3,049,444 | 8/1962 | Palombo et al. . | |
| 5,038,930 | 8/1991 | Holtkamp, Jr. | 206/423 X |

FOREIGN PATENT DOCUMENTS

| | | | |
|---|---|---|---|
| 1509585 | 1/1968 | France . | |
| 2272914 | 12/1975 | France . | |
| 3014032 | 11/1981 | Germany | 206/423 |
| 3514514 | 10/1986 | Germany . | |
| 8811241 | 10/1988 | Germany . | |
| 9109363 | 9/1991 | Germany . | |
| 891078 | 3/1962 | United Kingdom | 47/89 |
| 2087339 | 5/1982 | United Kingdom | 206/423 |

OTHER PUBLICATIONS

*Patent Abstracts of Japan*, vol. 015, No. 450 (C–0885) 15 Nov. 1991, Publication No. JP 03 191 909, Publication Date 21 Aug. 1991, Application No. JP890334099, Application Date 21 Dec. 1989.

*Patent Abstracts of Japan*, vol. 016, No. 030 (M–1203) 24 Jan. 1992, Publication No. JP 03 240 670, Publication Date 28 Oct. 1991, Application No. JP900034545, Application Date 15 Feb. 1990.

*Primary Examiner*—Bryon P. Gehman

*Attorney, Agent, or Firm*—Speckman Pauley Petersen & Fejer

[57] ABSTRACT

A transport vase which has a moisture container for storing cut flowers. The moisture container is constructed of an outer flexible wrapper which forms a relatively thin water-tight pouch. An absorbent material is positioned within the flexible wrapper and the absorbent material can be saturated with water or liquid nutrients.

11 Claims, 2 Drawing Sheets

TRANSPORT VASE FOR CUT FLOWERS

BACKGROUND OF THE INVENTION

1. Field of the Invention

This invention relates to a vase which is especially suited for storing, transporting, and keeping fresh cut flowers, especially, in entire bouquets.

2. Description of Prior Art

Florists normally give cut flowers to their customers wrapped in paper without any moisture dispenser, or frequently pack the stems wrapped in a water-saturated wad of cotton or a small sponge. Another known type of transport for maintaining freshness is a small container which cannot be sealed water tight at the stem and thus tends to leak, and there is also the danger of the edges of these containers damaging the flower stems.

SUMMARY OF THE INVENTION

It is one object of this invention to provide a vase for transporting cut flowers and the like, which stores a liquid nutrient and discharges it to the flowers as required, without the liquid nutrient leaking out, regardless of position. The unrestricted position is important because bouquets of flowers are often carried with the flowering part in the downward position and the stems pointing upward.

An additional advantage of this invention is that the proposed transport vase, when not in use, requires minimum space and is of minimum weight. If not in use, these transport vases may be carried in pants pockets and may be filled or saturated with water wherever needed in order to fulfil their function. This type of transport vase may be manufactured in any size and color and is extremely economical.

An additional advantage of this invention is that the transport vase will not become moist or wet on the outside and thus will not disintegrate. It also provides to the stems excellent protection against pressure and heat; conversely, skin and hands will not get wet, and direct contact with the stems is avoided. As a result, allergic skin reactions which are caused by certain plants can be prevented.

BRIEF DESCRIPTION OF THE DRAWINGS

This invention is described below in connection with the drawings, in which.

DESCRIPTION OF PREFERRED EMBODIMENTS

Figure 1:
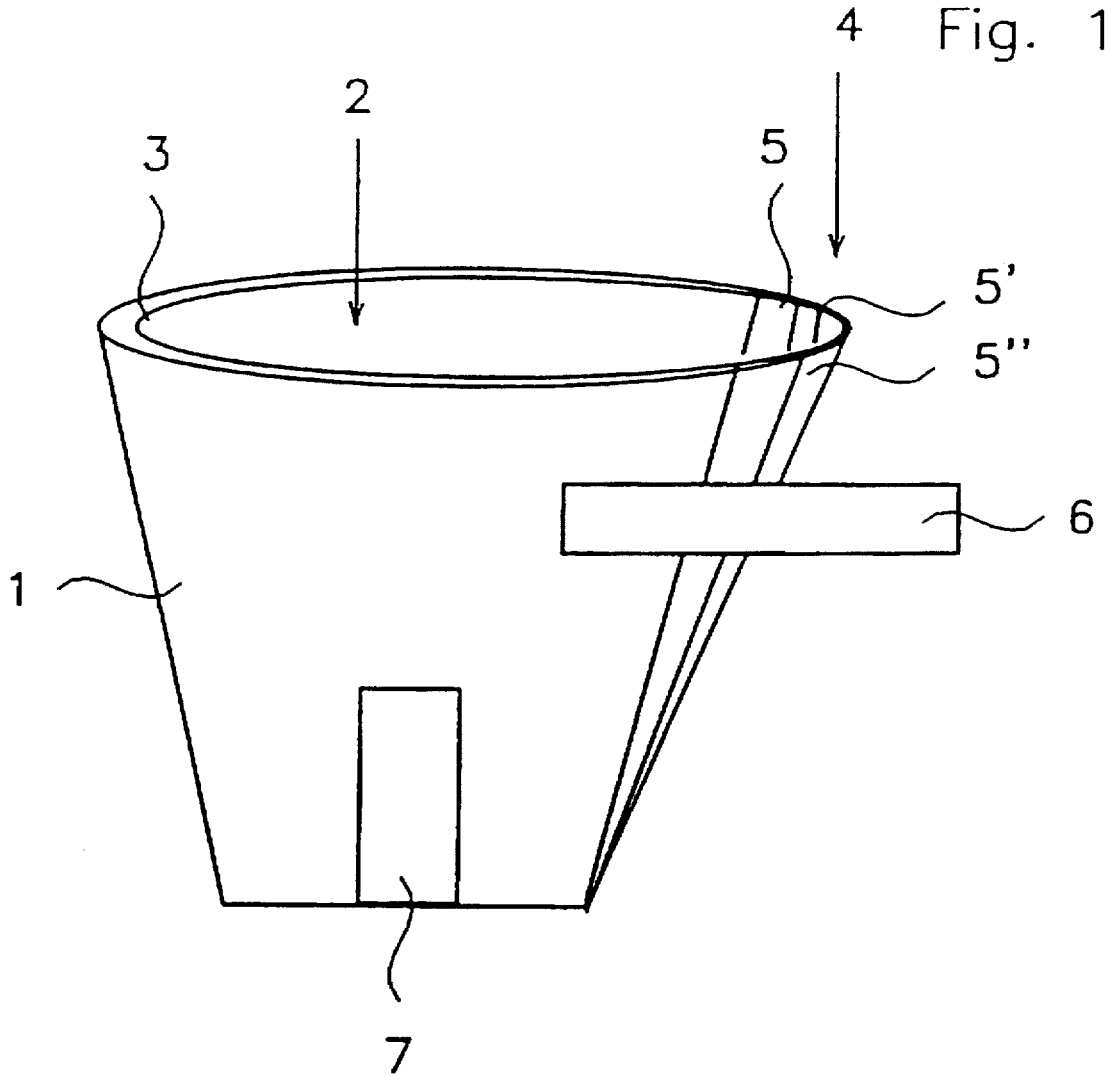
FIG. 1 is a perspective view of one preferred embodiment of the transport vase according to this invention.

FIG. 1 is a perspective view of one preferred embodiment of the transport vase according to this invention. A flexible container comprises a water-tight wrapper 1 which, on an inside 2 is coated with a layer of an absorbent material 3, preferably cellulose, resembling cotton. This absorbent material 3 serves as liquid nutrient storage. The absorbent material 3 is not saturated with the liquid nutrient until it is actually used.

In one portion of a circumference 4 the water-tight wrapper 1 is not coated with the absorbent material 3, but instead, is pre-folded in corrugations or in the shape of a fan 5, 5', 5". This facilitates the insertion of flowers since a larger opening is available. If the liquid nutrients are added and the flowers are inserted, the wrapper 1 is pleated in order to obtain a better grip around the stems of the flowers. Then a re-closeable adhesive strip 6, which is fixed in a location on an outer facing of the wrapper 1, is placed around the pleated side and in this manner holds the entire transport vase together such that the flower stems do not slip out.

The liquid nutrients are maintained in the absorbent material 3, from where they are discharged to the stems of the flowers as needed. The absorbent material 3 may absorb and store liquid nutrients several times its own weight. Due to the consistency of the absorbent material 3, such as is known, for example, from diapers, the liquid nutrient is retained and secured against leakage. A moisture indicator 7 is arranged in any desired location in the lower region of the transport vase and allows the storage of the liquid to be monitored visually from the outside.

In another preferred embodiment according to this invention, the transport vase comprises two, basically trapezoidal, segments of the water-tight wrapper 1 which are coated with a formed fabric and which, on their side and bottom, are welded or glued together, like a coffee filter.

Figure 2:
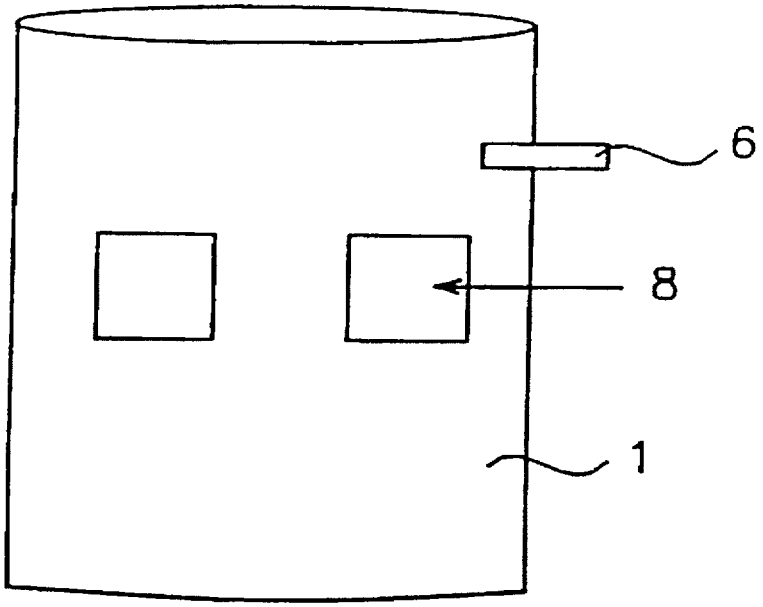
FIG. 2 is a perspective view of another preferred embodiment of the transport vase according to this invention.

FIG. 2 shows another embodiment of the transport vase. The transport vase is the shape of a wrapper or pouch which is open on one side and, if not in use, is approximately rectangular in shape. On the one side in the upper region there is a re-closeable adhesive strip 6 which can be used to pull the vase together and secure the flower stems. Pouches 8 may be arranged in the front or back. The pouches 8 may be made of the same thin sheet as the wrapper 1 itself, or may be made of a different foldable thin material. These serve for the insertion of small bags of known fresh-keeping substances for cut flowers and for insertion of greeting or business cards and preferably match the dimensions of the same. The transport vase may be configured in various colors, and the pouches may be imprinted, for example, with advertisements.

Figure 3:
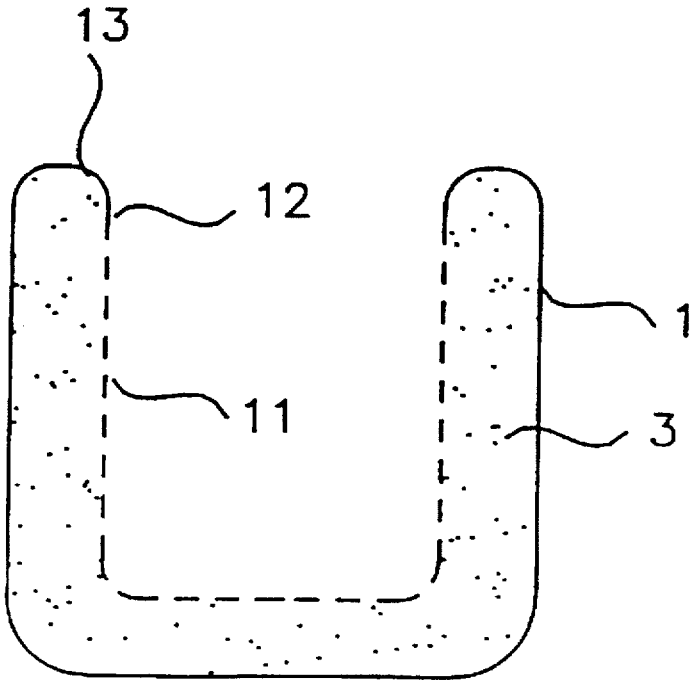
FIG. 3 is a cross section of a transport vase according to this invention.

FIG. 3 is a cross section of the transport vase, according to one preferred embodiment of this invention, in the open state. The water-tight wrapper 1 has the shape of the letter U which is open toward the top, with the wrapper material being pulled as an envelope 13 around the upper ends of the transport vase, and on the inside it is pulled down a certain distance. The wrapper 1 thus partly encloses the absorbent material 3 in this region and forms a type of upside-down groove that is open toward the bottom. This groove prevents the water from possibly running out if the flower bouquet is held upside down in the transport vase.

A layer of the absorbent material 3 is inserted into the pouch-shaped water-tight wrapper 1. Especially suitable absorbent materials are cellulose, for example in the form of cotton, foamed material, sponge-like material and the like. The absorbent material 3 which, due to its internal characteristics, has a capillary effect, additionally promotes the distribution of liquid.

Toward the inside, the layer of the absorbent material 3 is covered by a thin porous or perforated sheet 11. This thin porous sheet 11 may also comprise plastic having small holes. However, a formed fabric such as a geo-textile or a fine fabric is also suitable. The thin porous sheet 11 is securely connected at its upper edge with the edge of the water-tight wrapper 1 on the inside of the envelope 13 by means of adhesion or welding 12.

Water poured into the transport vase is distributed in the absorbent material 3 and may, to a certain extent, move into this material. If the flower bouquet is held upside down in the transport vase, the water tends to move to the bottom. However, it is retained in the envelope 13 due to the water-tight wrapper 1 and is prevented from running out. If a suitably absorbent material 3, for example a foamed material, is used, the thin porous sheet 11 may be dispensed. The wrapper 1 is preferably made of a skid-resistant and tear-resistant and biodegradable material. The absorbent material 3 and the thin porous sheet 11 should also be made of biodegradable material if possible, such that the transport vase may be re-used and/or recycled.

I claim:

1. A transport vase having a moisture container for storing cut flowers, the transport vase comprising: the moisture container having an outer flexible wrapper (1) of a thin water-tight sheet formed as a pouch, an outer facing of said wrapper (1) having at least one secondary pouch (8) into which fresh-keeping bags can be inserted, and an absorbent material (3) situated within said flexible wrapper (1), which can be saturated with a liquid.

2. A transport vase according to claim 1, wherein said flexible wrapper (1) has an upper edge that is pulled down on an inside region of said flexible wrapper (1) and partially encloses said absorbent material (3) in said inside region.

3. A transport vase according to claim 1, wherein said absorbent material (3) comprises cellulose.

4. A transport vase according to claim 1, wherein said absorbent material (3) comprises a sponge material.

5. A transport vase according to claim 1, wherein said absorbent material (3) is covered by a thin porous sheet (11).

6. A transport vase according to claim 1, wherein at least one re-closeable adhesive strip (6) is attached to said wrapper (1) and can be pulled around flower stems of the cut flowers so that said wrapper (1) can be secured with said at least one adhesive strip (6).

7. A transport vase according to claim 1, wherein said absorbent material (3) is a coating secured to said wrapper (1).

8. A transport vase according to claim 1, wherein an outer facing of said wrapper (1) has a moisture indicator (7) arranged in a suitable location.

9. A transport vase having a moisture container for storing cut flowers, the transport vase comprising: the moisture container having an outer flexible wrapper (1) of a thin water-tight sheet formed as a pouch, and an absorbent material (3) situated within said flexible wrapper (1), which can be saturated with a liquid, said absorbent material (3) being covered by a thin porous sheet (11), and said absorbent material (3) being a coating secured to said wrapper (1).

10. A transport vase having a moisture container for storing cut flowers, the transport vase comprising: the moisture container having an outer flexible wrapper (1) of a thin water-tight sheet formed as a pouch, and an absorbent material (3) situated within said flexible wrapper (1), which can be saturated with a liquid, at least one re-closeable adhesive strip (6) attached to said wrapper (1) which can be pulled around flower stems of the cut flowers so that said wrapper (1) can be secured with said at least one adhesive strip (6) and an outer facing of said wrapper (1) has a moisture indicator (7) arranged in a suitable location.

11. A transport vase according to claim 10, wherein said outer facing of said wrapper (1) has at least one secondary pouch (8) into which flesh-keeping bags can be inserted.

* * * * *